US006362797B1

(12) United States Patent
Dehmlow

(10) Patent No.: US 6,362,797 B1
(45) Date of Patent: Mar. 26, 2002

(54) APPARATUS FOR ALIGNING MULTIPLE PROJECTED IMAGES IN COCKPIT DISPLAYS

(75) Inventor: Brian P. Dehmlow, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/311,946

(22) Filed: May 14, 1999

(51) Int. Cl.[7] ..... G09G 3/00
(52) U.S. Cl. ..... 345/32; 353/30
(58) Field of Search ..... 345/7, 9, 32; 353/30, 353/34, 42, 46–51, 122; 250/206.1, 227.11–227.32

(56) References Cited

U.S. PATENT DOCUMENTS 4,001,840 A * 1/1977 Becker et al.
5,422,693 A * 6/1995 Vogeley et al. ..... 353/42
5,707,128 A * 1/1998 Dugdale ..... 353/122
5,847,784 A * 12/1998 Finnila et al. ..... 343/34
5,902,030 A * 5/1999 Blanchard ..... 353/30
5,988,817 A * 11/1999 Mizushima et al. ..... 353/30

* cited by examiner

*Primary Examiner*—Regina Liang
(74) *Attorney, Agent, or Firm*—Nathan O. Jensen; Kyle Eppele

(57) ABSTRACT

An apparatus and method for aligning portions of a tiled projection display which become misaligned during operation of the display, including interposing at least one two-dimensionally electro-mechanically gimballed glass plate in the projection path of one of the display sections. Sensing the misalignment of the tiles and automatically adjusting the alignment in response thereto. Further having apparatus and steps for alignment of the tiles based upon operational characteristics of an aircraft upon which the display is used.

23 Claims, 1 Drawing Sheet

APPARATUS FOR ALIGNING MULTIPLE PROJECTED IMAGES IN COCKPIT DISPLAYS

FIELD OF THE INVENTION

The present invention generally relates to large area, or panoramic, cockpit displays and even more particularly relates to such displays having multiple image projectors illuminating a common viewing screen.

BACKGROUND OF THE INVENTION

In the past, designers of avionics displays have endeavored to provide larger and larger display devices to better provide for enhanced situation awareness for flight crews. The use of projection displays in cockpits is gaining many followers because of their recognized ability to provide large area, or panoramic, displays. One method for creating large, high resolution displays is to illuminate a single viewing screen with multiple image projectors, These multiple projector images may be arranged as contiguous non-overlapping, partially overlapping, or totally overlapping image segments. All such configurations may be referred to as tiled image displays. The resulting large image, being comprised of several smaller images, may be referred to as a composite image. While these displays have many advantages, they also have significant drawbacks.

Tiled projection displays must maintain a high degree of alignment precision to provide the superior performance necessary for avionics enhanced situation awareness displays. However, the cockpit is not a mechanically static or benign environment. In-flight turbulence, forces of impact upon landing and other forces resulting from maneuvering the aircraft can be substantial, especially for smaller aircraft and most especially, for fighter aircraft used in operation on-board aircraft carriers. These forces can cause mechanical displacement of the projectors, viewing screens, and other components. Normal variations in aircraft temperature can also cause the projectors, or their images, to move.

Consequently, there exists a need for dynamic alignment of tiled projection displays.

SUMMARY OF THE INVENTION

It is an object of the present invention to provide tiled projection displays having a superior image alignment characteristic.

It is a feature of the present invention to utilize a multi-axis adjustable beam deflector.

It is an advantage of the present invention to optically align tiled projected images.

It is another feature of the present invention to include a static compensator.

It is another advantage of the present invention to reduce aberration corrections required for unequal optical path lengths.

It is yet another feature of the present invention to include electro-mechanical gimbal drive motors and gimbal angle sensing devices.

It is yet another feature of the present invention to include electro-optical sensing devices for detecting and measuring undesired image displacement.

It is yet another advantage of the present invention to provide a fully functional tiled projection display system which is capable of in-flight adjustment to compensate for misalignment.

It is yet another advantage of the present invention to provide misalignment correction in an automated manner that eliminates manual alignment operations.

It is still yet another feature and advantage of the present invention to provide a means for mechanically-isolated, independently mounted projectors and display screens.

It is still yet another advantage of the present invention to provide for easy mounting of aligned systems.

The present invention is an apparatus and method for aligning tiled projection images, which is designed to satisfy the aforementioned needs, provide the previously stated objects, include the above-listed features and achieve the already articulated advantages. The present invention is carried out in a "misaligned image-less" manner in a sense that the time that a misalignment condition is allowed to exist has been greatly reduced.

Accordingly, the present invention is a tiled projection display system which utilizes a multi-axis adjustable optical beam deflector.

BRIEF DESCRIPTION OF THE DRAWINGS

The invention may be more fully understood by reading the foregoing description of the preferred embodiments of the invention, in conjunction with the appended drawing wherein:

The FIGURE is a simplified schematic diagram of a tiled projection image system of the present invention, showing light emanating from the projectors and beam deflectors as solid lines and with the dotted lines used to show a viewing angle of a camera. The projectors illuminate the viewing screen, while the camera simultaneously views the resulting composite image.

DETAILED DESCRIPTION

Figure 1:
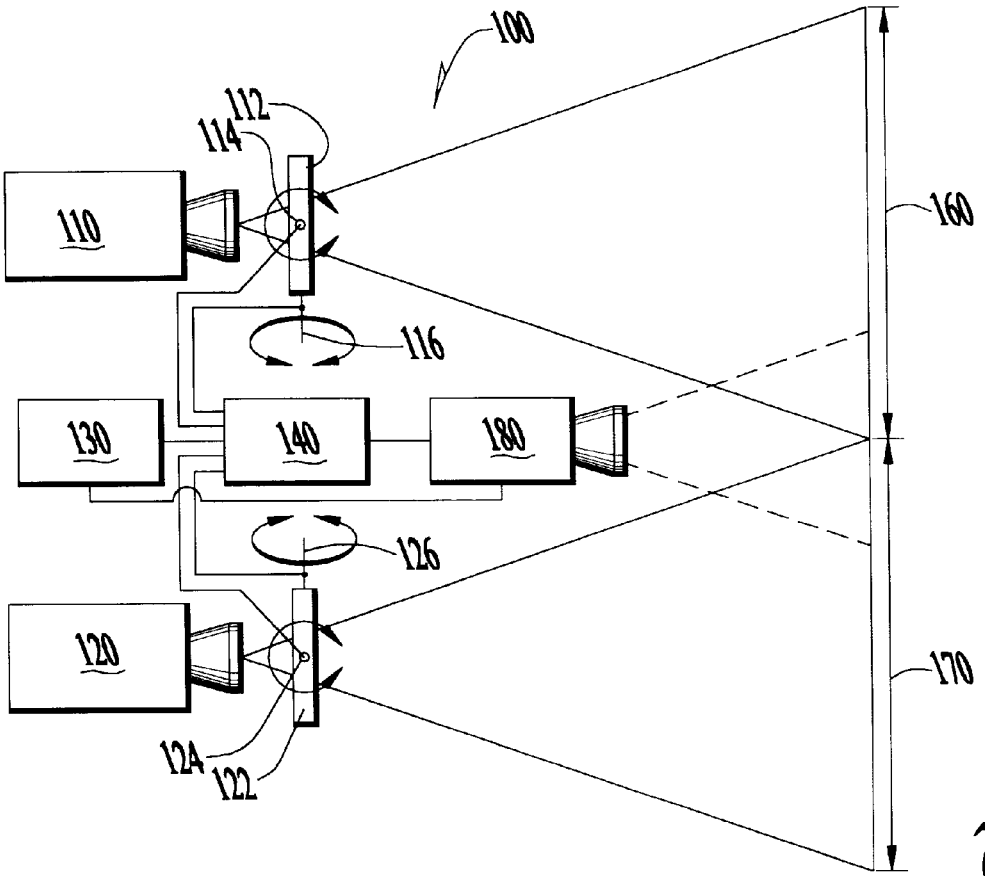

Now referring to the drawing wherein like numerals refer to like matter throughout, there is shown a system of the present invention, generally designated 100, having a first projector 110 and a second projector 120, which may be any type of projector used for projecting portions of a tiled image, such projectors being well known in the art. The description herein focuses upon a multiple projector system which is believed to be a common design choice. However, it is understood that use of a single projector is also contemplated by this invention, and the multi-projector description is merely an example of various possibilities. Projectors 110 and 120 generally emit light to form a portion of an image 160 and 170 respectively. Images 160 and 170 may be projected on to various types of viewing surfaces which are well known in the art, such as a diffuser disposed in the instrument panel of an aircraft. The diffuser or other optical device is chosen to provide a wide or tailored viewing angle to facilitate in some designs a simultaneous cross-cockpit viewing from multiple members of the flight crew and in others, a highly focused high gain display. In the present invention, we show a tiled display with separate viewing surfaces for images 160 and 170. However, in some circumstances, it may be desirable to superimpose both images onto one screen. The images may be identical, and the superimposition may provide for redundancy and increased brightness, etc. The present invention is intended to include superimposed displays despite the references herein to tiled displays. Tiled displays are merely an example of various types, including superimposed and others. Disposed between projectors 110 and 120 and their respective viewing surfaces are beam deflectors 112 and 122 respectively. Beam deflectors 112 and 122 may be any type of optical element capable of repositioning the projected images 160 and 170 respectively, in a controllable fashion. One type of optical element that may be particularly useful for beam deflectors 112 and 122 is a relatively thick piece of transparent glass with flat, parallel faces. Because of the flat parallel faces, the glass "plate" would have zero optical power. It is well known that such glass plates will deflect an optical beam when the plate is tilted with respect to the beam direction. The amount of deflection is determined by the thickness of the plate (t), angle of incidence (θ) and index of refraction of the plate (n), according to the formula:

$$d = t\sin\left[\theta_i - \sin^{-1}\left(\frac{\sin\theta_i}{n}\right)\right] \Big/ \cos\left[\sin^{-1}\left(\frac{\sin\theta_i}{n}\right)\right]$$

This equation describes the deflection in one direction only. It can be extended to two dimensions for glass plates or beam deflectors which are capable of two dimensional motion. In a preferred embodiment, beam deflectors 112 and 122 each include a two axis gimbal which are capable of horizontally deflecting the images 160 and 170, respectively by rotation around vertical axes 114 and 124 respectively. Vertical deflections of the images 160 and 170 can be achieved by rotating the beam deflectors 112 and 122, respectively about horizontal axes 116 and 126. In a preferred embodiment, the beam deflectors 112 and 122 are capable of automatic self-adjusting for any misalignment that may occur during operation of the system 100. A preferred system may include some means for electronically controlling the beam deflectors 112 and 122, which is represented in the FIGURE as a control block 130 for controlling gimbal drives 140, which may be a well-known electromechanical device coupled to the beam deflectors 112 and 122 by any appropriate connection means. The control block 130, and the gimbal drives 140 and the connections with each other and the beam deflectors are well known in the art. A camera 180 is shown coupled to control block 130. Camera 180 is also well known in the art and is used to monitor the alignment of images 160 and 170. The camera 180 may also detect infrared registration information or fiducial marks projected along with the desired image to aid in image alignment. Control block 130 may receive a signal from the camera 180 and process it to determine the existence, extent and direction of any misalignment of images 160 and 170. The circuitry or software for such detection is well known in the art, and it may be located in the camera 180 itself or in a central control block 130 or in any other configuration, such as in the projectors 110 and 120 or distributed among them and other control devices.

In an alternate embodiment, one of the beam deflectors may be omitted or may be a stationary glass plate without any gimbal and gimbal drive and which is not coupled to the camera 180. The alignment could be completely achieved by manipulation of the other beam deflector only. This could achieve a cost and weight savings. This stationary glass plate would be optically identical to the gimballed beam deflector and, therefore, would maintain equal optical path lengths from projectors 110 and 120 to images 160 and 170. The maintenance of equal optical path lengths should provide for less aberration correction than otherwise might occur with unequal optical path lengths. In an alternate embodiment, the beam deflectors 112 and 122 may be incorporated into their respective projectors 110 and 120 and may be located either between the projection optics of the projectors, not shown, and the images 160 and 170 (as shown in the FIGURE) or between the projection optics and an image source, not shown, in the projector. The exact implementation details may vary, depending upon the particular needs of the system and the customer and the component parts chosen by the designer and or customer.

In operation, the apparatus and method of the present invention could function as follows:

An image to be projected upon a display surface is determined, the image is projected by at least two projectors, each projecting a separate portion of the tiled image, a camera or other detector is used to monitor the alignment of the separate portions to assure that no gaps or overlapping occurs. This monitoring can be done with a servo loop feedback type arrangement where the images are moved in a predetermined manner and the motion is monitored and controlled to minimize gaps and overlapping of the separate portions. The motion of the images is achieved by manipulating, in one or more dimensions, a rotation of one or more of the beam deflectors 112 and 122. When a misalignment occurs, the situation will be detected by the above-described monitoring function and will be corrected as part of the monitoring function. The projectors 110 and 120 and control block 130 may be coupled to flight control computers or inertial reference systems on-board the aircraft (not shown). The image to be displayed, the algorithms that control movement of gimbals, and how the image is displayed may be changed as a function of the operation of the aircraft. For example, if the aircraft is involved in landing maneuvers or is being subjected to high forces, then the image to be displayed may be altered or the system or method for monitoring the alignment of the tiled images may be adjusted. Other operational schemes can be utilized as well.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. An apparatus for projecting an image in an aircraft cockpit comprising:

a first projector for projecting a first image, in a first projection beam;

a second projector for projecting a second image, in a second projection beam;

a viewing screen for viewing the first image and the second image;

a first beam deflector disposed between said first projector and said first image;

a second beam deflector disposed between said second projector and said second image;

a beam deflector drive for continuously manipulating an orientation of at least one of said first beam deflector and said second beam deflector in response to a beam deflector drive signal; and a sensor for sensing an alignment characteristic of said first image and said second image and generating the beam deflector drive signal in response to said alignment characteristic.

2. An apparatus of claim 1 wherein said first beam deflector has a two-dimensional gimbal coupled to an optical element having a predetermined optical characteristic.

3. An apparatus of claim 1 wherein said first beam deflector is a stationary flat glass plate.

4. An apparatus of claim 2 wherein said second beam deflector is a two-dimensional gimbal coupled to an optical element having a predetermined optical characteristic.

5. An apparatus of claim 1 wherein said sensor is an infrared sensing camera.

6. An apparatus of claim 1 wherein said first image and said second image are superimposed.

7. An apparatus for displaying a projection image comprising:

means for projecting a first portion of the projection image;

means for projecting a second portion of the projection image;

means for sensing an alignment characteristic of said first portion with respect to said second portion and generating a beam deflector drive signal in response thereto; and means for continuously manipulating an alignment of said first portion in response to said beam deflector drive signal.

8. An apparatus of claim 7 wherein said means for manipulating is responsive to an aircraft inertial reference signal representative of an operational characteristic of an aircraft.

9. An apparatus of claim 7 wherein said means for manipulating is an electro-mechanically driven two-dimensional gimballed optical element.

10. An apparatus of claim 9 wherein said optical element is a flat glass plate having a first index of refraction and a first thickness dimension.

11. An apparatus of claim 10 further including a second flat glass plate.

12. An apparatus of claim 11 wherein said second fat glass plate is stationary and has a second thickness dimension similar to said first thickness dimension, and a second index of refraction which is similar to said first index of refraction.

13. An apparatus of claim 10 wherein said second flat glass plate is an electro-mechanically driven two-dimensional gimballed optical element.

14. An apparatus of claim 13 wherein said means for manipulating is responsive to an aircraft inertial reference signal representative of an operational characteristic of an aircraft.

15. An apparatus of claim 7 wherein said first portion of the projection image and said second portion of the projection image are superimposed.

16. A method of aligning a first projected image with a second projected image in an image array comprising the steps of:

sensing an alignment characteristic of said first projected image with respect to said second projected image and generating an image beam deflector drive signal in response thereto;

interposing an optical element between a projector, which projects said first projected image and a viewing surface upon which said first project image is incident;

continuously manipulating said optical element in response to said image beam deflector drive signal to effect a change in relative position of said first projected image with respect to said second projected image.

17. A method of claim 16 further comprising the step of manipulating said optical element in response to a signal representative of an operational characteristic of an aircraft.

18. A method of claim 16 wherein said step of manipulating an optical element includes rotating an optical element around a vertical axis.

19. A method of claim 18 wherein said step of manipulating an optical element further includes rotating said optical element around a horizontal axis.

20. A method of claim 16 wherein said step of sensing an alignment characteristic includes transmission and detection of non-visible fiducial marks for aiding in alignment of said first projected image with said second projected image.

21. An avionics display for displaying a projected image comprising:

a projector disposed on an aircraft, said projector for emitting a projection beam;

a viewing screen;

a beam deflector for changing a direction of said projection beam;

sensor for monitoring the alignment characteristic of said projection beam;

means for real time manipulating of said beam deflector as a function of said alignment characteristic.

22. A display of claim 21 wherein said variable characteristic is a signal output from an alignment sensor.

23. A display of claim 21 wherein said variable characteristic is a function of an operational characteristic of said aircraft.

* * * * *